US007343866B2

(12) United States Patent
Mercx

(10) Patent No.: US 7,343,866 B2
(45) Date of Patent: Mar. 18, 2008

(54) WASTE-THROUGHPUT LIMITING CONTROL

(75) Inventor: Josef Mercx, Baden (CH)

(73) Assignee: Von Roll Umwelttechnik, AG, Zurich (CH)

( * ) Notice: Subject to any disclaimer, the term of this patent is extended or adjusted under 35 U.S.C. 154(b) by 323 days.

(21) Appl. No.: 11/258,094

(22) Filed: Oct. 26, 2005

(65) Prior Publication Data

US 2006/0090679 A1 May 4, 2006

(30) Foreign Application Priority Data

Nov. 2, 2004 (EP) ..... 04025933

(51) Int. Cl.
*F23G 5/50* (2006.01)

(52) U.S. Cl. ..... 110/346; 110/101 CC; 110/101 C; 110/185

(58) Field of Classification Search ..... 110/186, 110/348, 235, 101 C, 101 CF, 101 CC, 346; 60/648, 652
See application file for complete search history.

(56) References Cited

U.S. PATENT DOCUMENTS 4,311,102 A * 1/1982 Kolze et al. ..... 110/103
5,230,293 A 7/1993 Schirmer
5,280,756 A * 1/1994 Labbe ..... 110/191
5,501,159 A * 3/1996 Stevers et al. ..... 110/188
5,784,974 A * 7/1998 Krauss ..... 110/186
6,644,222 B1 11/2003 van Kessel et al.

FOREIGN PATENT DOCUMENTS

| | | |
|---|---|---|
| EP | 0 499 976 | 10/1996 |
| EP | 0 919 770 | 6/1999 |
| EP | 0 718 553 | 9/1999 |
| EP | 0 943 864 | 8/2003 |
| WO | WO 01/25691 | 4/2001 |

* cited by examiner

*Primary Examiner*—Kenneth Rinehart
(74) *Attorney, Agent, or Firm*—Hershkovitz & Associates, LLC; Abe Hershkovitz

(57) ABSTRACT

Waste-throughput limiting control device (MBR) comprising at least one averaging unit (ME), a waste-throughput limiting controller (MBr) and a minimum unit (MIN). Starting from a waste weight (MG) applied to a charging system of the waste incineration plant and a predetermined maximum waste throughput, the waste-throughput limiting control device (MBR) adapts a steam output setpoint (DS). which is intended for further processing at a downstream primary combustion control (FLR), in such a way that an economically appropriate (time-limited) operation, acceptable from the plant engineering point of view, within a defined overload region is made possible and prolonged overloading due to an unhindered increase in the waste feed during the incineration of waste having a low calorific value is efficiently prevented.

19 Claims, 2 Drawing Sheets

WASTE-THROUGHPUT LIMITING CONTROL

CROSS-REFERENCE TO RELATED APPLICATIONS

The present application claims priority under 35 U.S.C. 119 of European Patent Application No. 04 025 933.5, filed on Nov. 2, 2004, the disclosure of which is expressly incorporated by reference herein in its entirety.

BACKGROUND OF THE INVENTION

1. Field of the Invention

The invention relates to a method of operating a waste incineration plant, to a waste-throughput limiting control device, and to a waste incineration plant.

2. Discussion of Background Information

In waste incineration plants, a thermal output occurring during the incineration of the waste can be utilized for conversion into electrical energy. For this purpose, the heat of combustion is coupled via heat exchangers to steam generating means in steam boilers. The steam generated is directed via a steam distributor to a steam turbine and serves there to drive it. A steam mass flow in [kg/s] is generally specified as a measure of the steam output produced.

For the provision of a constant electrical output by the steam turbine, it is in turn advantageous to keep the thermal or the steam output constant. For this purpose, fluctuations in the calorific value of the waste, due to a varying composition of the substances, different porosity and lumpiness, and a changing water content, must be evened out by technical measures. These technical measures include, inter alia, adaptation of the waste throughput.

A method of operating a waste incineration plant has been disclosed, for example, by EP-B-0499976. In this case, for the uniform generation of the heat quantity, the waste feed and the primary air feed are influenced by means of a cascade control acting in the same direction. The generated steam quantity is detected and serves as a main command variable. Pronounced changes in the nature of the waste and thus in the calorific value, which changes require a change in the operating parameters in the opposite direction, are accordingly compensated for inadequately by this primary combustion control.

Such a requirement occurs, for example, when moist waste—that is to say waste having a greatly reduced calorific value—is fed to the combustion space. If the waste throughput is increased in the same direction, this may lead to incomplete combustion, the thermal output not being adequately increased. In the extreme case, extinction of the fire may even occur.

Described in WO-A-01/25691 is a method of incinerating waste in which this circumstance is taken into account. To this end, the manipulated variables—waste throughput and air feed to the combustion space—are influenced starting from two control variables—the steam output produced and the oxygen content in the combustion space. In this case, the control is effected in such a way that the waste throughput or the air feed is reduced by a protective element if a predetermined maximum value is exceeded by at least one of the control variables.

Since the waste throughput in this method is detected indirectly via the steam output produced, discrepancies may occur in practice between this indirectly detected waste throughput and the actual waste throughput. In addition, the indirectly detected waste throughput involves a quasi-current instantaneous value. With regard to the entire dwell time of the waste during the feeding and the transport through the combustion space, which is in the order of magnitude of 2 h, the indirect detection of the quasi-current instantaneous value causes a considerable time delay in the possible reaction with regard to the loading of the charging system.

SUMMARY OF THE INVENTION

The object of the present invention is therefore to provide a control unit for a primary combustion control of a waste incineration plant, with which control unit the actual waste throughput and thus the charging state are detected and a continuous overload operation, not desired from the operational point of view, of the waste incineration plant is avoided.

The object is achieved by a method of operating a waste incineration plant and by a waste-throughput limiting control device.

The method according to the invention provides protection from prolonged overloading due to an unhindered increase in a waste feed during the incineration of waste having a low calorific value by adapting a steam output setpoint of a primary combustion control. To this end, starting from at least two input signals, namely a waste weight applied to a charging system of the waste incineration plant and a predetermined maximum waste throughput, the steam output setpoint, for further processing in the primary combustion control, is adapted in such a way that, at an averaged waste throughput which is determined as a function of the waste weight and is greater than a limit value dependent upon the maximum waste throughput, the steam output setpoint is reduced.

The waste-throughput limiting control device according to the invention for carrying out the method is a protective device which has an averaging unit, a waste-throughput limiting controller and a minimum unit. Starting from the two input signals already mentioned above, namely the waste weight and the maximum waste throughput, the waste-throughput limiting control device produces the steam output setpoint. The steam output setpoint is in this case adapted in such a way that it is essentially reduced at an averaged waste throughput which is determined as a function of the waste weight and is greater than a limit value dependent upon the maximum waste throughput. Consequently, the downstream primary combustion control will reduce the waste throughput.

By means of such a method of controlling the steam output setpoint as command variable for the downstream primary combustion control, an economical operation at the predetermined working point is ensured within the specified working region, an economically appropriate operation, limited with respect to time and acceptable from the plant engineering point of view, within the overload region is made possible, and prolonged overloading due to an unhindered increase in the waste feed during the incineration of waste having a low calorific value is efficiently prevented.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein advantageous embodiments of the invention are described with reference to the following figures. In the drawing, in detail.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
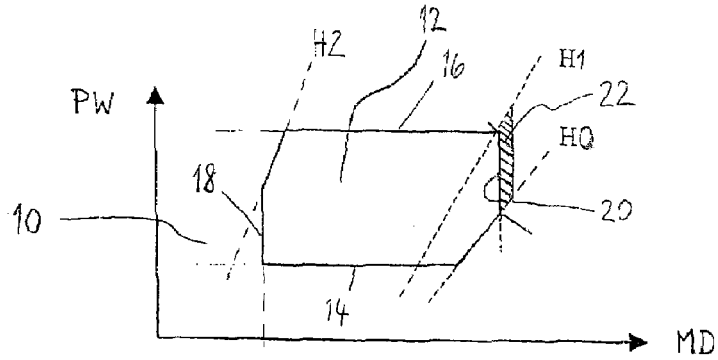
FIG. 1 shows a firing diagram having a working region and a tolerable overload region.

A firing diagram 10 like that shown in FIG. 1 forms the basis for the design of a waste incineration plant. The thermal output PW produced during the incineration process is shown in the firing diagram 10 as a function of the waste throughput MD. Furthermore, parameters plotted therein are straight lines of calorific values H0, H1, H2 of various waste qualities. A hexagonal zone borders a working region 12 which is specified for the waste incineration plant and comprises all of the continuous load states ensured by the manufacturer.

The working region 12 is limited by straight lines of a low calorific value H0 and of a high calorific value H2, of a minimum thermal output 14 and of a maximum thermal output 16, and also of a minimum waste throughput 18 and of a maximum waste throughput 20. The thermal output PW and the waste throughput MD of a desired working point in the working region 12 fluctuate as a result of an inhomogeneous waste quality and on account of a discontinuous loading of a charging system. In particular at working points which lie on the straight lines of the maximum thermal output 16 and of the maximum waste throughput 20, these fluctuations may lead to overload states. As a rule, brief overload states within the range of minutes do not lead to damage to the waste incineration plant. On the other hand, prolonged overload states are to be prevented in order to avoid consequences such as material fatigue, congestion in the charging system, an unstable firing position or an infringement of statutory provisions.

Along the straight line of the maximum thermal output 16, overload states lasting for a longer period can be effectively prevented by abovementioned primary combustion controls FLR. On the other hand, in the overload region 22 adjoining along the straight line of maximum waste throughput 20, which is hatched in the firing diagram 10, the waste-throughput limiting control device MBR described subsequently, also referred to more succinctly as waste-throughput limiting control, intervenes in order to prevent overload states which last for a longer period. In this sense, the waste-throughput limiting control MBR acts as a protective device. The waste-throughput limiting control MBR in this case behaves in the sense of a cascade control as master controller for the command variable steam setpoint DS of a downstream primary combustion control FLR, for example according to EP-B-0499976.

Figure 2:
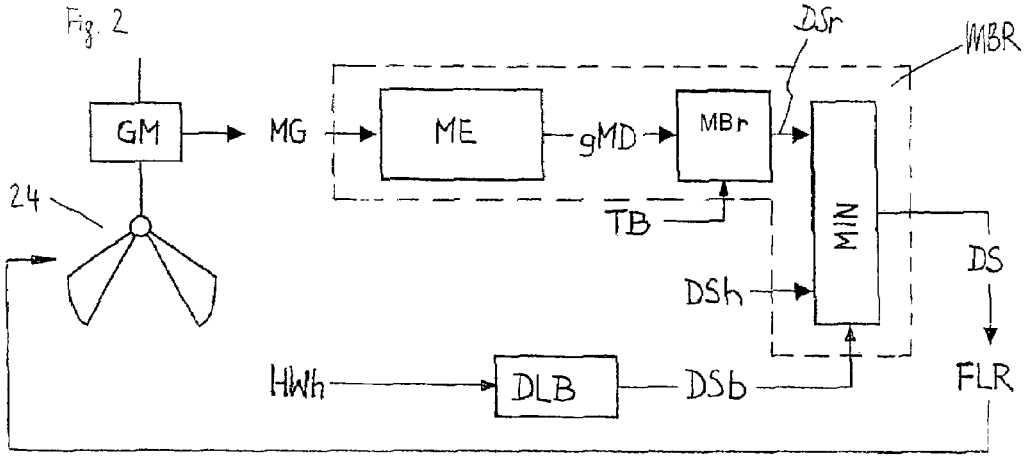
FIG. 2 shows a block diagram of a waste-throughput limiting control device (MBR)

A block diagram of a waste-throughput limiting control MBR is shown in FIG. 2. The material input, that is to say the charging with waste, is effected by means of a grab 24 of a crane installation. The waste is released in the process into a hopper (not shown) of a filling shaft and in this way loads a feeder system (likewise not shown). A waste weight MG picked up by the grab 24 is determined by means of a weight measuring cell GM and is transmitted via an electrical signal line to the waste-throughput limiting control MBR. The detection of the waste weights MG permits a detailed knowledge and analysis of the instantaneous state of the charging system (charging state) and allows specific intervention for adapting the charging state if the waste composition changes. In addition, through this knowledge of the charging state and with the inclusion of an instantaneous steam output valve, it is possible to extrapolate future positions of the working point and thus future operating states.

The waste-throughput limiting control MBR is defined in FIG. 2 by a broken line and has in this preferred embodiment the following units: an averaging unit ME, a waste-throughput limiting controller MBr and a minimum unit MIN. In this embodiment, the units ME, MBr and MIN are implemented in terms of hardware and/or software by means of electronic components. Alternatively, however, the units ME, MBr and MIN may also be realized by means of pneumatic components.

The averaging unit ME receives as input signal the waste weights MG of the waste poured in each case into the hopper. From this, over an averaging period of 1 h to 5 h, preferably 3.5 h, the averaging unit ME determines a sliding average from the waste weights MG, divides this sliding average by the averaging period and thereby produces an averaged waste throughput gMD. In the present embodiment, the waste weights MG are in this case weighted with the convolution function 26 depicted by a broken line in FIG. 3.

Figure 3:
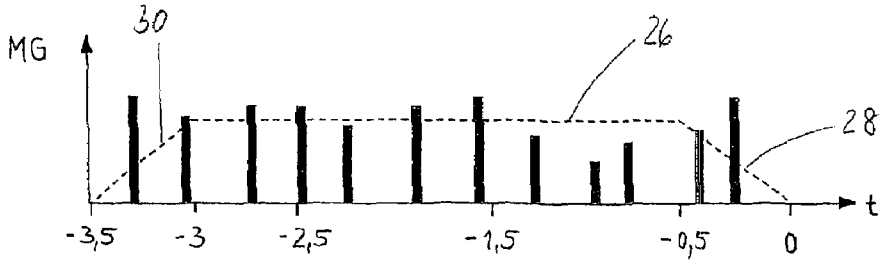
FIG. 3 shows a diagram having a chronological sequence of waste weights and a convolution function for determining an averaged waste throughput.

In the diagram in FIG. 3, examples of waste weights MG are shown as a function of time t in the form of bars plotted discretely with respect to time. The averaging period extends from −3.5 h to 0 h and is therefore 3.5 h. The convolution function 26 depicted in FIG. 3 has a flank 28 rising steadily from the instant 0 h and leading with respect to time and a flank 30 falling steadily from the instant −3 h and trailing with respect to time. Between the leading and trailing flanks 28, 30, the convolution function 26 runs at least approximately constantly. The averaging period may of course be adapted to specific requirements. Thus, for example, it proves to be appropriate in practice to form a further sliding average over 8 h, which can flow into the control or be made available to an operator as additional information. Like the averaging period, the convolution function 26 may of course also be adapted to specific conditions.

The calculation of a sliding time average within the time domain corresponds to filtering in the frequency domain. Therefore the averaging unit ME described above is equivalent to a low-pass filter and can also be replaced physically by such a low-pass filter. Accordingly, to adapt the convolution function 26 at the averaging unit ME, various parameters may also be adapted to the specific conditions in the case of a low-pass filter. In the sense of a low-pass filter, the averaged waste throughput gMD represents equalization of the waste weights MG poured discretely into the hopper.

As input signal of the waste-throughput limiting controller MBr arranged downstream of the averaging unit ME, a "dead band" TB is supplied in addition to the averaged waste throughput gMD. From the two input values gMD, TB, the waste-throughput limiting controller MBr determines a controlled steam output setpoint DSr. The construction and the function of the waste-throughput limiting controller MBr is described in detail in connection with FIG. 4.

The minimum unit MIN adjoining the waste-throughput limiting controller MBr in the signal flow receives, in addition to the controlled steam output setpoint DSr, a steam output setpoint DSh determined by manual intervention by the operator and a calculated steam output setpoint DSb. The calculated steam output setpoint DSb is determined in a steam output calculation unit DLB from at least one calorific value HWh, to be input by the operator, with the aid of model calculations. The minimum unit MIN determines the smallest of the three input signals DSr, DSh, DSb and transmits this output signal of the waste-throughput limiting control MBR as steam output setpoint DS to the downstream primary combustion control FLR. The primary combustion control FLR then generates corresponding manipulated variables which influence the loading of the charging system via the grab 24.

Figure 4:
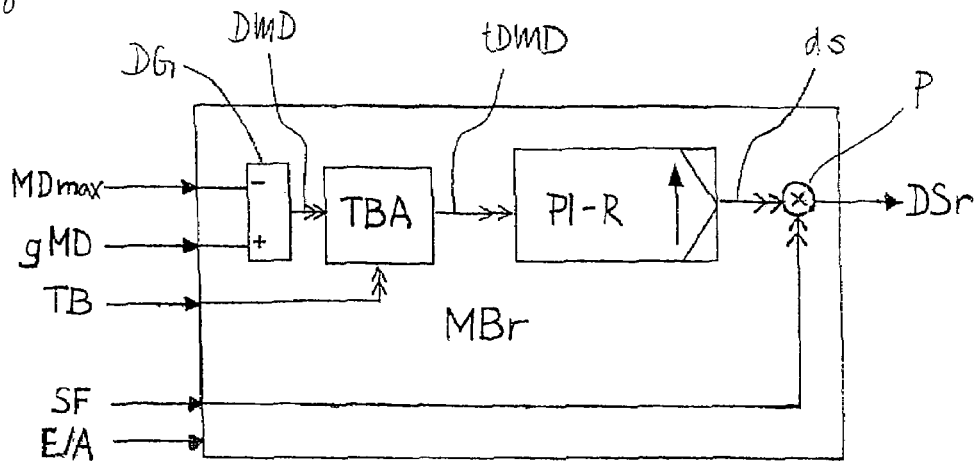
FIG. 4 shows a block diagram of a waste-throughput limiting controller.

A detailed block diagram of the waste-throughput limiting controller MBr is shown in FIG. 4. In addition to the input signals—the averaged waste throughput gMD and the dead band TB—already mentioned in connection with FIG. 2, the waste-throughput limiting controller MBr has three further input signals not shown in the overview illustration: a maximum waste throughput MDmax, a scaling factor SF and an on/off switching signal E/A.

In the signal flow direction, first of all a differential waste throughput DMD is determined from the difference between the averaged waste throughput gMD and the maximum waste throughput Mdmax in a differential element DG. As input signal, the differential waste throughput DMD is fed together with the dead band TB to a dead-band adapting element TBA.

Figure 5:
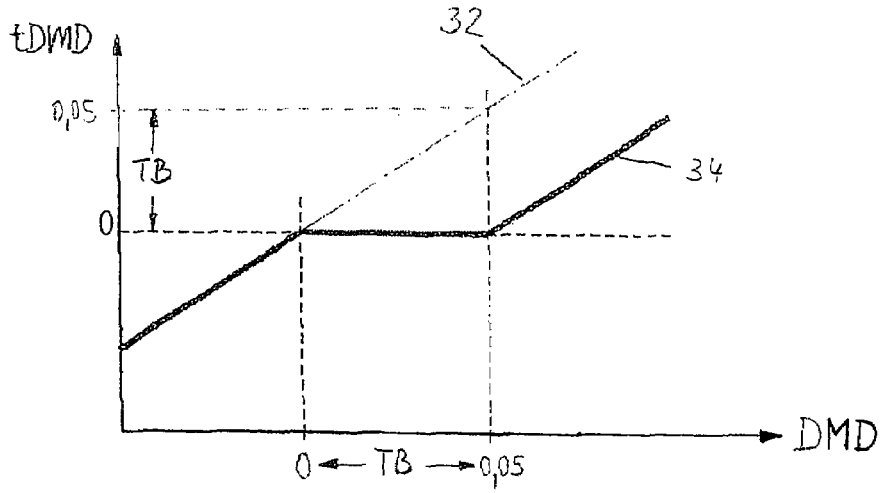
FIG. 5 shows a diagram which shows the initial signal of the waste-throughput limiting controller (MBr) as a function of waste throughput while taking into account a dead band.

The function of the dead-band adapting element TBA will now be explained in connection with FIG. 5. The diagram in FIG. 5 shows an output signal tDMD of the dead-band adapting element TBA as a function of the differential waste throughput DMD. In the case of a negative differential waste throughput DMD, which is the case if the averaged waste throughput gMD is less than the maximum waste throughput Mdmax (gMD<MDmax), the dead-band adapting element TBA transmits the differential waste throughput DMD (tDMD=DMD) to its output-and thus to a downstream PI controller PI-R. If the differential waste throughput DMD now reaches the value zero and exceeds the zero value up to a value predetermined by the dead band TB (0<=DMD<=TB), by 5% or 0.05 in the case shown, the output value tDMD of the dead-band adapting element TBA continues to be kept at zero (tDMD=0). This achieves the effect that the PI controller PI-R essentially does not react within the interval [0. . . TB]. Smaller fluctuations of the averaged waste throughput gMD in the order of magnitude of the dead band TB which occur at the limit of the maximum waste throughput 20 are in this way suppressed or smoothed. This leads to a smoother characteristic of the output signal DS of the waste-throughput limiting control MBR and permits the overload operation in the overload region 22, hatched in FIG. 1, of the firing diagram 10.

During a further increase in the differential waste throughput DMD (DMD>TB) beyond the value of the dead band TB, the output signal tDMD=DMD−TB is reduced by the magnitude of the dead band TB. For comparison, a dot-dash line 32 is plotted in the diagram in FIG. 5 along the function tDMD=DMD. If the averaged waste throughput gMD is reduced and thus the differential waste throughput DMD is also reduced again, the output signal tDMD covers the continuous thick line, plotted in FIG. 5, of the transfer function 34 of the dead-band adapting element TBA in the opposite direction.

This design of the dead-band adapting element TBA ensures that the waste incineration plant is operated close to the maximum waste throughput 20, MDmax, and is thus operated economically, overload states at the same time being tolerated to a predetermined degree.

The output valve tDMD is passed to the PI controller PI-R of known construction and function. A proportional coefficient and a reset time can be set as parameters of the PI controller PI-R but are not specified separately in FIG. 4 as input signals. The input signal tDMD is treated as a deviation by the PI controller PI-R, this deviation being minimized in accordance with the selected parameters. For this purpose, the PI controller essentially increases an output signal ds in the case of a negative deviation, that is to say as long as the averaged waste throughput gMD is less than the maximum waste throughput MDmax, and reduces the output signal as soon as the deviation has a positive sign, that is to say the averaged waste throughput gMD less the dead band TB exceeds the maximum waste throughput Mdmax.

As an alternative to the embodiment described having a PI controller, a PID controller or a fuzzy controller may of course also be used.

The output signal ds of the PI controller PI-R, by multiplication with the scaling factor SF at a multiplication element P, is converted into the controlled steam setpoint DSr and fed to the following minimum unit MIN.

The further input signal E/A allows the automatic operation of the waste-throughput limiting control MBR having the waste-throughput limiting controller MBr to be switched on or off.

The function of the MBR is described below based on three essential situation scenarios:

1. The averaged waste throughput gMD lies below the maximum waste throughput 20, MDmax, that is to say in the working region 12. The differential element DG of the waste-throughput limiting controller MBr accordingly delivers a negative input signal DMD<0 to the dead-band adapting unit TBA, which, on the basis of its transfer function 34 described above, transmits the value of the differential waste throughput DMD to the PI controller PI-R. The PI controller PI-R (ignoring its time response) reacts to the correspondingly negative deviation with an increase in its output signal ds. After the scaling of the output signal ds in the multiplication element P, the steam output setpoint DSr is evaluated in the following minimum unit MIN. If the thus determined steam output setpoint DSr is smaller than the manually set or calculated steam output setpoint DSh, DSb, said steam output setpoint DSr is transmitted as the current command value to the primary combustion control FLR. This control sequence will increase the steam output setpoint DS until the minimum unit MIN selects a changed manually set or calculated steam output setpoint DSh, DSb as minimum. The waste throughput can be further increased in this way by the primary combustion control FLR and economical operation at the predetermined working point is ensured.

2. The averaged waste throughput gMD lies above the maximum waste throughput 20, MDmax, but is less than the sum of the maximum waste throughput Mdmax and the dead band TB. The working point in the firing diagram 10 therefore lies within the tolerable working region 22. The differential element DG of the waste-throughput limiting controller MBr accordingly delivers a positive input signal DMD less than/equal to the dead band TB to the dead-band adapting unit TBA. According to its transfer function 34, it transmits the value zero to the PI controller PI-R. The PI controller (ignoring its time response) essentially reacts to the deviation of zero in such a way that it maintains unchanged the last output value of the output signal ds before reaching this "equilibrium state". After the scaling of the output signal ds in the multiplication element P, this steam output setpoint DSr thus determined is evaluated in the following minimum unit MIN. If the manually set or calculated steam output setpoint DSh, DSr has likewise not changed after the last change of the controlled steam output setpoint DSr, the steam output setpoint DS transmitted to the primary combustion control FLR remains unchanged. In this way, a (limited) operation which is economically appropriate and acceptable from the plant engineering point of view is ensured within the overload region.

3. The averaged waste throughput gMD is greater than the sum of the maximum waste throughput 20, MDmax, and the dead band TB; the working point therefore lies outside the working region 12 and the tolerable overload region 22. The differential element DG of the waste-throughput limiting controller MBr delivers a negative input signal DMD to the dead-band adapting unit TBA, which, taking into account the dead band TB, transmits a positive value greater than zero to the PI controller PI-R. The PI controller PI-R (ignoring its time response) reacts to the correspondingly positive deviation with a reduction in its output signal ds. After the scaling of the output signal ds in the multiplication element P, the controlled steam output setpoint DSr thus determined is evaluated in the downstream minimum unit MIN. On the assumption that the manually set and calculated steam output setpoints DSh, DSb have not been changed since the last change of the controlled steam output setpoint DSr, the minimum unit MIN now transmits the reduced controlled steam output setpoint DSr as new current steam output setpoint DS to the primary combustion control FLR. By this reduction in the steam output setpoint DS, a further increase in the waste feed through the existing primary combustion control FLR is efficiently prevented.

The method of operating the waste-throughput limiting control MBR described above comprises at least the step that, starting from at least two input signals, namely the waste throughput MG and the predetermined maximum waste throughput MDmax, an output signal, steam output setpoint DS, for further processing in the primary combustion control FLR, is generated in such a way that, at the averaged waste throughput gMD which is determined as a function of the waste weight MG and is greater than a limit value dependent upon the maximum waste throughput MDmax, the steam output setpoint DS is reduced in order to prevent a continuous overload operation of the waste incineration plant. A further input signal, namely a dead band TB, is preferably included in the method in such a way that, at an averaged waste throughput gMD which is greater than the maximum waste throughput MDmax and is less than or equal to the limit value which results from the sum of the values of the maximum waste throughput MDmax and the dead band TB, the steam output setpoint DS (with unchanged manually set and calculated steam output setpoints DSh, DSb) remains constant. The averaged waste throughput gMD is determined in the averaging unit ME in a preceding method step as a sliding time average from the waste weights MG.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A method of operating a waste incineration plant, in which method prolonged overloading on account of an unhindered increase in a waste feed during the incineration of waste having a low calorific value (HO) is prevented by adapting a steam output setpoint (DS) of a primary combustion control (FLR), wherein, starting from at least two input signals, namely a waste weight (MG) applied to a charging system of the waste incineration plant and a predetermined maximum waste throughput (MDmax), the steam output setpoint (DS), for further processing in the primary combustion control (FLR), is adapted in such a way that, at an averaged waste throughput (gMD) which is determined as a function of the waste weight (MG) and is greater than a limit value dependent upon the maximum waste throughput (MDmax), the steam output setpoint (DS) is reduced.

2. The method as claimed in claim 1, wherein a further input signal, namely a dead band (TB), for determining the steam output setpoint (DS), is included in a further method step in such a way that, at an averaged waste throughput (gMD) which is greater than the maximum waste throughput (MDmax) and is less than or equal to the limit value which results from the sum of the values of the maximum waste throughput (MDmax) and the dead band (TB), the steam output setpoint (DS) remains essentially constant.

3. The method as claimed in claim 2, wherein the value of the dead band (TB) is 0% to 20%, of a differential waste throughput (DMD), the differential waste throughput (DMD) resulting from the difference between the averaged waste throughput (gMD) and the maximum waste throughput (MDmax).

4. The method as claimed in claim 1, wherein, in a further method step, the averaged waste throughput (gMD) is determined from the waste weights (MG) as a sliding time average in an averaging unit (ME).

5. The method as claimed in claim 4, wherein, in the averaging unit (ME), the averaged waste throughput (gMD) is determined by sliding time averaging with a weighted convolution function (26) rising slowly at its leading flank (28) with respect to time and falling slowly at its trailing flank (30) with respect to time.

6. The method as claimed in claim 5, wherein the leading flank (28) of the convolution function (26) rises linearly over a period of 0.1 h to 2 h, the convolution function (26) is at least virtually constant between the leading and the trailing flank (26, 28), and the trailing flank (28) of the convolution function (26) falls linearly over a period of 0.1 h to 2 h.

7. The method as claimed in claim 5, wherein the sliding time averaging extends over a period of 1 h to 5 h.

8. The method as claimed in claim 1, wherein in a further method step, in a minimum unit (MIN), the steam output setpoint (DS) is determined as a minimum of an output signal (DSr), delivered by a waste-throughput limiting controller (MBr), of a manually set steam output setpoint (DSh) and of a calculated steam output setpoint (DSb).

9. A waste-throughput limiting control device for carrying out the method as claimed in claim 1, having a controller, wherein the controller is designed as a waste-throughput limiting controller (MBr), arranged upstream of which is an averaging unit (ME) for calculating an averaged waste throughput (gMD) and arranged downstream of which is a primary combustion control (FLR), and wherein the waste-throughput limiting control device (MBR) is capable of receiving at least two input signals, namely a waste weight (MG) applied to a charging system of the waste incineration plant and a predetermined maximum waste throughput (MDmax), and of outputting a steam output setpoint (DS) for further processing in the primary combustion control (FLR).

10. The waste-throughput limiting control device as claimed in claim 9, wherein the waste-throughput limiting controller (MBr) is designed as a proportional-plus-integral (PI) controller (PI-R).

11. The waste-throughput limiting control device as claimed in claim 9, wherein the waste-throughput limiting controller (MBr) has a dead-band adapting unit (TBA) for processing a further input signal, namely a dead band (TB), as a result of which the steam output setpoint (DS) is determined in such a way that, at an averaged waste throughput (gMD) which is greater than the maximum waste throughput (MDmax) and is less than or equal to the limit value which results from the sum of the values of maximum waste throughput (MDmax) and the dead band (TB), the steam output setpoint (DS) remains essentially constant.

12. The waste-throughput limiting control device as claimed in claim 9, wherein the averaging unit (ME) is designed as a low-pass filter.

13. The waste-throughput limiting control device as claimed in claim 9, wherein it has a minimum unit (MIN) which determines the steam output setpoint (DS) as a minimum of an output signal (DSr), delivered by the waste-throughput limiting controller (MBr), of a manually set steam output setpoint (DSh) and of a calculated steam output setpoint (DSb).

14. A waste incineration plant including a waste-throughput limiting control device (MBR) having a controller, wherein the controller is designed as a waste-throughput limiting controller (MBr), arranged upstream of which is an averaging unit (ME) for calculating an averaged waste throughput (gMD) and arranged downstream of which is a primary combustion control (FLR), and wherein the waste-throughput limiting control device (MBR) is capable of receiving at least two input signals, namely a waste weight (MG) applied to a charging system of the waste incineration plant and a predetermined maximum waste throughput (MDmax), and of outputting a steam output setpoint (DS) for further processing in the primary combustion control (FLR)for carrying out the method as claimed in claim 1, which comprises a weight measuring cell (GM) which determines a waste weight (MG) picked up by a grab (24) and transmits said waste weight (MG) via a signal line to the waste-throughput limiting control device (MBR).

15. A waste incineration plant having the waste-throughput limiting control device (MBR) as claimed in claim 9 for carrying out a method, in which method prolonged overloading on account of an unhindered increase in a waste feed during the incineration of waste having a low calorific value (HO) is prevented by adapting a steam output setpoint (DS) of a primary combustion control (FLR), wherein, starting from at least two input signals, namely a waste weight (MG) applied to a charging system of the waste incineration plant and a predetermined maximum waste throughput (MDmax), the steam output setpoint (DS), for further processing in the primary combustion control (FLR), is adapted in such a way that, at an averaged waste throughput (gMD) which is determined as a function of the waste weight (MG) and is greater than a limit value dependent upon the maximum waste throughput (MDmax), the steam output setpoint (DS) is reduced, which comprises a weight measuring cell (GM) which determines a waste weight (MG) picked up by a grab (24) and transmits said waste weight (MG) via a signal line to the waste-throughput limiting control device (MBR).

16. The method as claimed in claim 3, wherein the value of the dead band (TB) is 5%.

17. The method as claimed in claim 6, wherein the leading flank (28) of the convolution function (26) rises linearly over a period of 0.5 h.

18. The method as claimed in claim 6, wherein the trailing flank (28) of the convolution function (26) falls linearly over a period of 0.5 h.

19. The method as claimed in claim 7, wherein the sliding time averaging extends over a period of 3.5 h.

* * * * *